United States Patent [19]

Szarka

[11] Patent Number: 4,574,882

[45] Date of Patent: Mar. 11, 1986

[54] PLUG CONTAINER

[75] Inventor: David D. Szarka, Duncan, Okla.

[73] Assignee: Halliburton Company, Duncan, Okla.

[21] Appl. No.: 665,690

[22] Filed: Oct. 29, 1984

[51] Int. Cl.[4] ..... E21B 33/05

[52] U.S. Cl. ..... 166/75.1; 166/70; 285/367

[58] Field of Search ..... 166/75.1, 70, 92–95, 166/153–156; 285/330, DIG. 14, 367, 411, 24

[56] References Cited

U.S. PATENT DOCUMENTS

| | | | |
|---|---|---|---|
| 1,016,620 | 2/1912 | Gapp | 285/388 |
| 2,319,518 | 5/1943 | Rau | 285/367 X |
| 2,630,179 | 3/1953 | Brown | 166/70 X |
| 2,647,582 | 8/1953 | Brown et al. | 166/70 X |
| 2,818,592 | 1/1958 | Scaramucci | 166/70 |
| 2,854,079 | 9/1958 | Schnitter | 166/70 |
| 2,876,842 | 3/1959 | McSpadden | 166/70 |
| 2,996,316 | 8/1961 | Terhune | 285/411 X |
| 3,216,500 | 11/1965 | Diehl | 166/70 |
| 3,322,197 | 5/1967 | Baker et al. | 166/75.1 |
| 3,444,928 | 5/1969 | Pitts | 166/70 |
| 3,545,542 | 12/1970 | Scott | 166/155 |
| 3,616,850 | 11/1971 | Scott | 166/155 |
| 3,863,716 | 2/1975 | Streich | 166/70 |
| 4,131,302 | 12/1978 | Leonard, Jr. | 285/367 X |
| 4,219,226 | 8/1980 | Kappenhagen | 285/388 X |
| 4,246,967 | 1/1981 | Harris | 166/75.1 |
| 4,290,482 | 9/1981 | Brisco | 166/70 |
| 4,522,430 | 6/1985 | Stromberg | 285/24 |
| 4,524,998 | 6/1985 | Brisco | 166/70 X |

OTHER PUBLICATIONS

Page 3138, Halliburton Services Sales and Service Catalog—No. 39.

Page 3843, Halliburton Services Sales and Service Catalog—No. 41.

Copies of FIGS. 1A, 1B, 7A and 7B of U.S. application Ser. No. 374,869, filed May 4, 1982, and entitled "Coupling Device".

*Primary Examiner*—Stephen J. Novosad

*Assistant Examiner*—Thuy M. Bui

*Attorney, Agent, or Firm*—E. Harrison Gilbert, III; Joseph A. Walkowski; Thomas R. Weaver

[57] ABSTRACT

A plug container has a flanged, splined end which mates with a complemental end of a casing adapter member. These two ends are secured to each other by a clamping mechanism which permits easy connecting and disconnecting of the two ends, thereby affording easy interchanging of different adapter members. The plug container has a cavity with a diameter larger than the outer diameter of the plug to be retained in the cavity so that pressure equalization around the plug is maintained without an external bypass. Pressure equalization is also maintained adjacent a cap which closes an end of the plug container. This pressure equalization of the cap is achieved by one or more radial openings in an abutment wall of the cap. The cap is sealed by a pressure-energized seal disposed in the interior surface of the housing into which the plug is threadedly connectible. Two manifold ports are disposed near the two ends of the cavity in which the plug is to be disposed.

11 Claims, 6 Drawing Figures

PLUG CONTAINER

BACKGROUND OF THE INVENTION

This invention relates generally to plug containers and more particularly, but not by way of limitation, to a compact plug container having a split-ring retained, splined coupling for connecting with a casing collar adaptor.

One operation which is often conducted during the completion of an oil or gas well is a cementing operation wherein fluid cement is pumped down the central bore of a well casing and out around the bottom of or the side of the well casing into an annulus between the well casing and the oil well borehole where the cement is allowed to harden to provide a seal between the well casing and the well borehole.

At the beginning of a typical cementing job, in rotary drilled wells, the well casing and the well borehole are usually filled with drilling mud. To reduce contamination at the interface between the drilling mud and the cement which is pumped into the well casing on top of the drilling mud, a bottom cementing plug is pumped ahead of the cement slurry so that the interface between the cement slurry and the drilling mud already in the well casing is defined by the bottom cementing plug.

As the cement is pumped into the well casing, the bottom cementing plug is pumped down the well casing. As it travels, the plug wipes mud from the walls of the casing ahead of the cement slurry, thereby reducing dilution of the cement slurry. When this bottom cementing plug reaches a predetermined plug stop, generally a float collar or float shoe located in a portion of the well casing, the bottom cementing plug seats and the differential pressure due to the high pressure cement located above the bottom cementing plug ruptures a diaphragm of the bottom cementing plug to allow the cement slurry to proceed down through the plug and then through the appropriate ports into the annulus between the well casing and the borehole.

At the completion of the mixing of the cement slurry, a top cementing plug is pumped into the well casing to similarly define an interface between the upper level of the cement slurry within the well casing and displacement fluid which is pumped in on top of the cement slurry. This top cementing plug is solid and when it is pumped to a pressure shut-off, the displacement of cement is terminated.

It is desirable to be able to place the cementing plugs in the well casing without opening the well casing. In such a situation, a plug container is mounted on top of the well casing. This plug container holds one or more of the cementing plugs and includes a mechanical retaining means which keeps the plugs from entering the well casing until the desired time.

Prior types of such plug containers have central bodies for holding one or more plugs, which bodies can have a plurality of ports for receiving the cement flows either above or below the positions where the plugs are held. These prior types of plug containers generally have casing adapters which are either threaded or integrally formed with the main bodies of the plug containers. The free ends of these adapters are threaded or clamped to the casing for connecting the plug container to the casing. Some prior types of plug containers have plug-receiving chambers with internal diameters which are greater than the outer diameters of the plugs retained within the chambers. Some prior art plug containers have internally threaded end plugs with pressure-energized seals and solid plug abutments. These end plugs, or caps, permit ready access to the internal chamber of the plug container such as for placing a plug therein or for connecting another plug container thereto.

Although there are prior art types of plug containers which include one or more of the aforementioned features, I am not aware of any plug container which combines each of these features in a single compact, versatile plug container. Furthermore, I am not aware of any such plug container which also enables the casing adapter to be quickly connected in a splined, clamped relationship to the main body of the plug container. Because plug containers can be bulky and hard to handle, there is the need for such a compact, versatile plug container which can be readily used at a well site.

SUMMARY OF THE INVENTION

The present invention meets the aforementioned needs by providing a novel and improved plug container which has a splined, clamped coupling with a casing adapter. Furthermore, the present invention has a relatively large diameter chamber or cavity for receiving a plug so that the fluid within the cavity can circulate around the plug without the need for an external bypass mechanism. The present invention also has an internally threaded end plug or cap with pressure-energized seals. This cap has a plug abutment with an opening therethrough for pressure equalization to preclude the development of a pressure differential which could prevent the plug from moving out of the plug container into the casing at the appropriate time. The present invention also has two ports for connecting in a manifold configuration with fluid sources, such as from a fluid cement source. These features provide in the present invention a compact, versatile plug container which can be quickly connected with a variety of casing adapters. In particular, the preferred embodiment of the present invention provides a short, light-weight plug container for medium duty pressure service.

Broadly, the present invention provides a plug container for holding a plug having an outer diameter. The plug container comprises housing means for receiving the plug, casing adapter means for engaging with a casing, and a split ring retainer means for releasably connecting the casing adapter means with the housing means. More particularly, the housing means has first spline means associated with an end thereof and the casing adapter means has second spline means for coupling with the first spline means.

The housing means also has an open end opposite the first spline means. The plug container further comprises closure means for closing the open end of the housing means. The closure means includes a closed outer wall, a central wall extending across and transverse to the outer wall, and an interior wall extending from the central wall to an end surface of the interior wall. When the plug is disposed in the housing means, it can abut the end surface. To prevent this abutment from establishing a pressure seal, the interior wall has an opening defined therethrough so that the pressure within an interior region defined by the interior wall is equalized with the pressure adjacent the exterior of the interior wall.

The housing means also has an interior surface defining a chamber in which the plug is disposed. The chamber has a diameter larger than the outer diameter of the plug so that fluid and pressure can pass between the interior surface of the housing means and the exterior of the plug.

The housing means also has associated therewith two ports for connecting with a fluid source containing a fluid to be pumped through the plug container into the well.

Therefore, from the foregoing, it is a general object of the present invention to provide a novel and improved plug container. Other and further objects, features and advantages of the present invention will be readily apparent to those skilled in the art when the following description of the preferred embodiment is read in conjunction with the accompanying drawings.

DETAILED DESCRIPTION OF THE PREFERRED EMBODIMENT

Figure 1A:
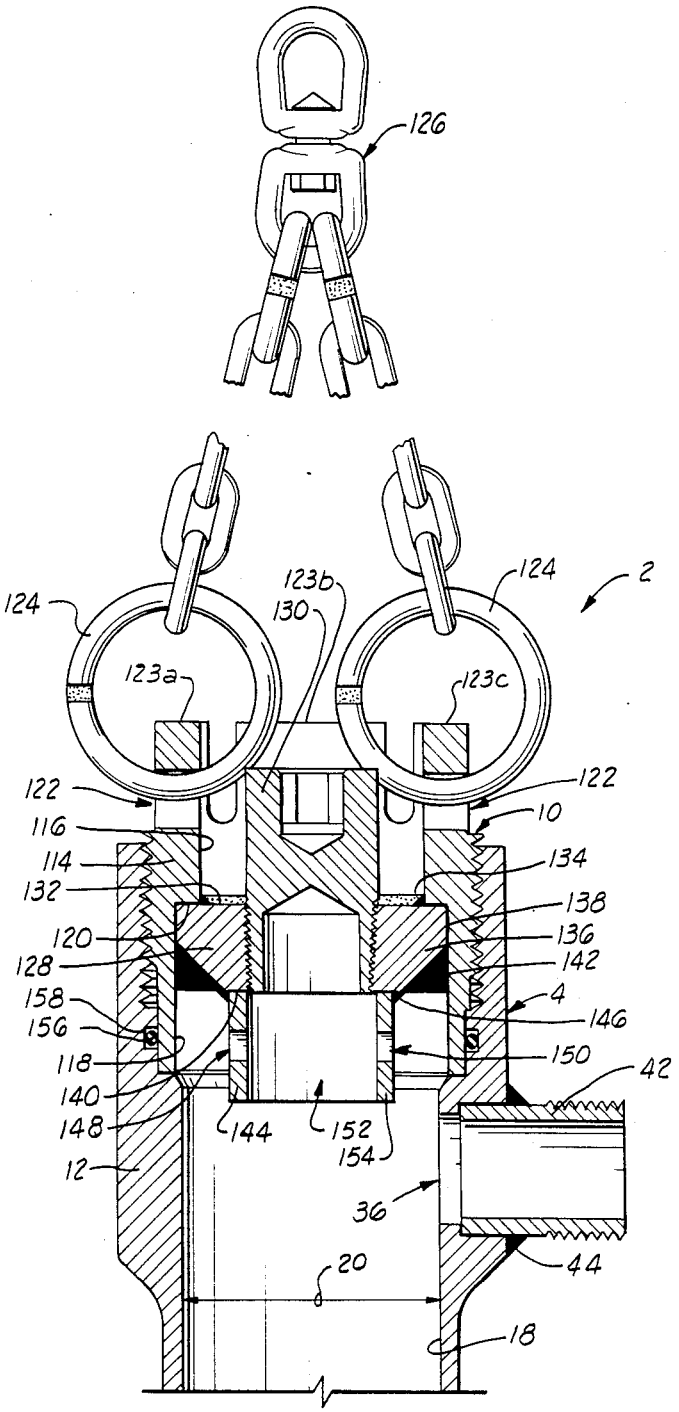
FIGS. 1A–1B form a sectional view of the preferred embodiment of the present invention shown oriented as it would be connected to the casing in a well.
Figure 1B:
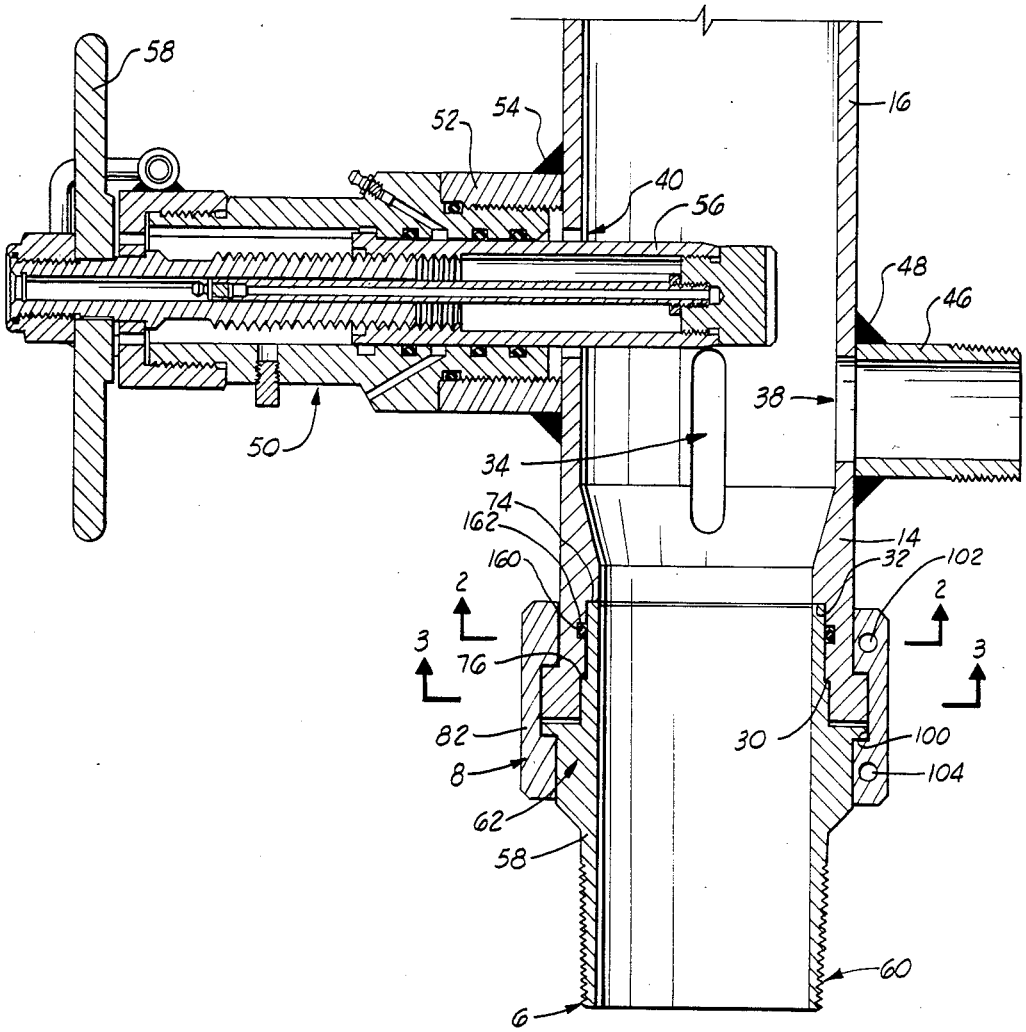

With reference initially to FIGS. 1A–1B, a plug container 2 constructed in accordance with the preferred embodiment of the present invention will be described. Broadly, the plug container 2 comprises a housing 4 for receiving a plug (not shown) having an outer diameter of a type as known to the art. The plug container 2 also includes a casing adapter member 6 which is connected to the housing 4 by a clamp mechanism 8. A closure means 10 is also associated with the housing 4. Sealing means as subsequently described are used between the housing 4 and the casing adapter member 6 as well as between the housing 4 and the closure means 10.

The housing 4 of the preferred embodiment comprises a substantially cylindrical member having an internally threaded box end portion 12 connected to a flanged, splined end portion 14 by means of an integral side wall 16. The side wall 16 has a cylindrical inner surface 18 defining a plug-receiving chamber or cavity having a constant diameter 20 through the length thereof between the box end portion 12 and the flanged, splined end 14. The diameter 20 is larger than the outer diameter of the plug which is to be disposed, via the open end of the box end portion 12, in the cavity defined by the inner surface 18; therefore, this larger diameter defines an annular flow space between the plug and the side wall. This significantly larger inner diameter of the plug container body makes the cementing plug free-fitting, thereby allowing pressures to always be equalized across the plug without the need of an external bypass mechanism which would make the device less compact. This larger diameter also makes the loading of the cementing plug through the open end of the box end portion 12 easier.

Figure 4:
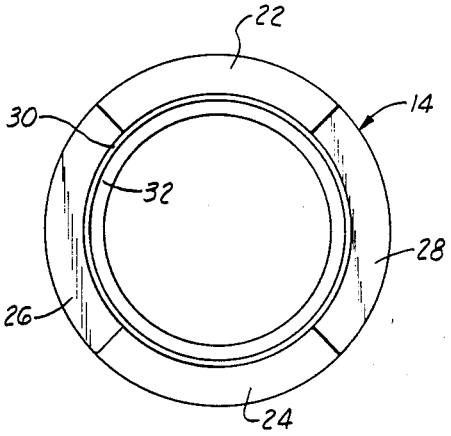
FIG. 4 is an end view of the splined end of the illustrated plug container housing.

The splines of the flanged, splined end portion 14 are more clearly shown in FIG. 4. The end portion 14 is shown in FIG. 4 as including two outwardly extending splines 22, 24 which are circumferentially spaced diametrically opposite each other by two spline-receiving sections 26, 28. Extending radially inwardly from the spline portions 22, 24, 26, 28 are an annular circumferential shoulder 30 and an annular circumferential shoulder 32 disposed longitudinally or axially back from the shoulder 30 as viewed in FIG. 4.

The side wall 16 has a longitudinal slot 34 defined therein for receiving an indicator mechanism of a type as known to the art for indicating when the plug has been released from the plug container 2. The side wall 16 also has three openings 36, 38, and 40 defined therein.

The openings 36, 38 form part of the manifolding structure of the present invention. That is, the opening 36 has an externally threaded sleeve 42 coaxially retained in a countersunk exterior portion of the opening 36 by means of a weld bead 44, and the opening 38 has an externally threaded sleeve 46 coaxially associated therewith by means of a weld bead 48. The sleeves 42, 46 enable the plug container 2 to be connected to a fluid source, such as a source of liquid cement which is to be pumped through the plug container 2 into the casing to which the plug container 2 is connectible. The flow can be either through the sleeve 42, whereby the fluid would flow on top of a plug contained in the cavity defined by the inner surface 18, or through the sleeve 46, whereby the fluid would enter the plug container 2 below the plug. The port members provided by the openings 36, 38 and their respective sleeves 42, 46 extend transversely through the side wall 16. The inclusion of this manifold capability in the present invention allows the cementing plug to be pumped out of the plug container 2 without rigging an additional line to the plug container 2. Therefore, cementing plugs may be easily launched under all conditions, such as from conventional casing jobs where the vacuum created by the falling cement is sufficient to launch the plug to bullhead squeeze jobs where the cementing head may be under high pressure and the plug must be pumped out of the head by necessity.

The opening 40 of the side wall 16 also extends transversely through the side wall 16 and provides an aperture through which a plug release plunger mechanism 50 of a type as known to the art can extend into the cavity of the plug container 2. The mechanism 50 is threadedly connected to a sleeve member 52 welded at 54 to the side wall 16 in coaxial relationship with the opening 40. The mechanism 50 includes a movable pin member or plunger 56 which is moved transversely into and out of the cavity defined in the plug container 2 by means of a rotatable wheel handle 58 as known to the art. Although not shown in the drawings, the mechanism 50 has a conventional flipper-type plug release indicator associated therewith to give a visual indication that the cementing plug has been launched successfully when the pin 56 is retracted from its position shown in FIG. 1B through the opening 40 whereby the plug retained thereabove is released. This conventional flipper-type plug release indicator is disposed in association with the slot 34. It is to be noted that the plug release mechanism can be of any suitable type which may be either locally or remotely controllable. The plug release indicator can also be of any suitable type, such as the aforementioned flipper-type, or a rotary wheel type, or an electromechanical type, for example.

The cylindrical plug retaining body provided by the housing 4 is connected to the casing adapter member 6 at the flanged, splined end 14. FIG. 1B shows that the casing adapter member 6 has a substantially cylindrical side wall 58 having an externally threaded lower end portion 60. The threaded portion 60 of the preferred embodiment couples with a casing collar of a type as known to the art. Generally, the end portion 60 can be of any suitable construction for connecting with casing either having a casing collar (such as by the illustrated threaded configuration or by a coupling device of the type disclosed in U.S. patent application Ser. No. 374,869, filed May 4, 1982, and assigned to the assignee of the present invention) or not having a collar (such as in flush joint casings).

Figure 5:
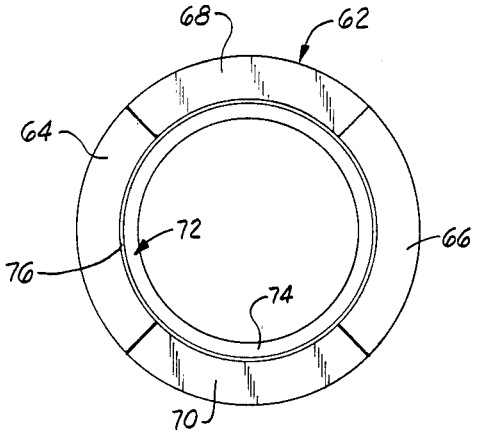
FIG. 5 is an end view of the splined end of the illustrated casing adapter member.

At the opposite end of the casing adapter member 6 there is defined by the side wall 58 a splined end portion 62. The configuration of this portion is more particularly illustrated in FIG. 5. FIG. 5 shows the end portion 62 has two outwardly extending splines 64, 66 circumferentially spaced diametrically opposite each other. Disposed between the splines 64, 66 are spline-receiving sections 68, 70. Extending axially outwardly from, or in front of, the sections 64, 66, 68, 70 (as viewed in FIG. 5) are a neck portion 72 having an end surface 74 and having an intermediate shoulder defined by a radial circumferential surface 76. The end portion 62 is configured for mating engagement with the flanged, splined end portion 14 of the housing 4. More particularly, the spline 22 and the spline 24 of the housing end portion 14 are received in the portions 68, 70, respectively, of the casing adapter member 6. The splines 64, 66 of the casing adapter member 6 are received in the portions 28, 26, respectively, of the housing end portion 14. The neck portion 72 of the casing adapter member 6 is received in the throat of the housing end portion 14 so that the end surface 74 abuts the receiving shoulder 32 of the housing end portion 14. This relationship is illustrated in FIG. 1B.

The casing adapter member 6 can be of any suitable construction so that the housing 4 can be connected with a selectable one of a plurality of members 6 depending upon the type of casing thread to which the plug container 2 is to be connected. So that such connections with different casing adapter members can be easily accomplished, the aforementioned splined construction is used in combination with the clamp means 8 construction. Additionally, the splined construction enables torque applied to the housing 4 to be transferred to the casing adapter member 6.

The clamp means 8 secures the flanged, splined end portion 14 with the splined end portion 62 (which end portion is also flanged) so that the mating splines are securely retained relative to each other. In the preferred embodiment the clamp means 8 includes a split ring retainer mechanism 78 shown in FIG. 2. Although split ring retainer mechanisms of the type disclosed herein are known and have been used to hold slip rings with packers, for example, I am not aware of a split ring retainer mechanism combined with a plug container housing and casing adapter member as disclosed herein.

Figure 2:
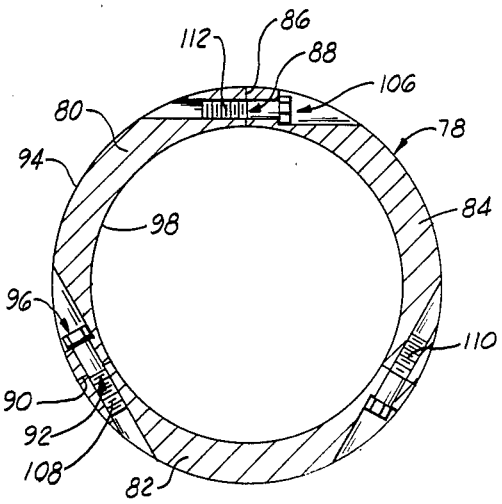
FIG. 2 is a sectional view of the split-ring retainer collar of the preferred embodiment of the present invention taken along line 2—2 shown in FIG. 1B.
Figure 3:
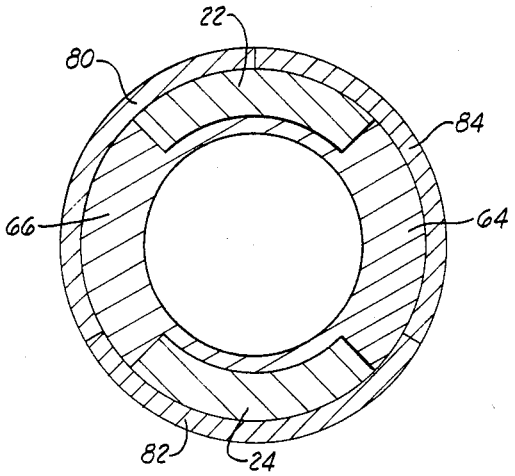
FIG. 3 is a sectional view taken along line 3—3 shown in FIG. 1B.

Although the split ring retainer mechanism can be of any suitable type including two or more members (preferably of identical shape and size), the split ring retainer mechanism 78 of the preferred embodiment includes three arcuate members 80, 82, 84. Each arcuate member has two end surfaces, each of which abuts a respective end surface of one of the other arcuate members. Considering the arcuate member 80, for example, FIG. 2 shows that this member has an end surface 86 having two threaded openings, one of which is shown in FIG. 2 and identified by the reference numeral 88. The arcuate member 80 includes another end surface 90 having two shank-receiving opening defined therein, one of which is shown in FIG. 2 and identified by the reference numeral 92. The arcuate member 80 includes an outer surface 94 having a countersunk opening 96 defined therein in communication with the shank-receiving opening 92. The arcuate member 80 also includes an inner surface 98 having a groove or notch defined therein (see FIG. 1B for a similar groove or notch 100 in the arcuate member 84). The groove or notch 100 is sized for receiving the coupled flanged portions of the end portions 14, 62 as illustrated in FIG. 1B. The other two arcuate members 82, 84 are similarly constructed. FIG. 1B shows shank-receiving openings 102, 104 of the arcuate member 84. The shank-receiving opening 102 communicates with a countersunk opening 106 and the threaded opening 88 as illustrated in FIG. 2.

To hold the arcuate members together, the clamp means 8 of the preferred embodiment further includes at least three bolt means which are disposed through respective countersunk openings, shank-receiving openings, and threaded openings of adjacent ones of the arcuate members 80, 82, 84. Three of these bolt means are shown in FIG. 2 as standard hex-head bolts 108, 110, 112. Three other similar bolts are used in the preferred embodiment in corresponding openings lying in front of those shown in FIG. 2, which other openings include the shank-receiving opening 104 shown in FIG. 1B.

The foregoing constructions of the housing end portion 14, the end portion 62 of the casing adapter member 6 and the clamp means 8 provide the plug container 2 of the present invention with an interchangeable pin end or casing adapter end which permits converting from one type of casing thread or connector to any other oil field casing thread or connector by simply changing the casing adapter member 6 rather than using changeover couplings in those situations where that is permitted or rather than having a different plug container to fit each casing thread or connector. This present coupling arrangement also permits the economical replacement of a casing thread in the field should the casing adapter member 6 become damaged or excessively worn. Such changes can be readily effected because of the split-ring clamp mechanism of the present invention which replaces the threaded or integral connections of the prior art. Additionally, by having the housing end portion 14 and the casing adapter end portion 62 splined so that they rotate with each other, the casing adapter member 6 may be tightened into and broken out of the casing by applying torque through the plug container body. This construction also provides a means for reducing or minimizing the length of the plug container 2.

At the end of the housing 4 opposite the splined end 14, the closure means 10 provides a removable cap for closing or opening the box end portion 12. The closure means 10 of the preferred embodiment includes a hollow cylindrical outer wall 114 having an externally threaded surface for threadedly engaging with the internally threaded surface of the box end portion 12. The wall 114 has an interior surface 116 radially inwardly offset from another surface 118 by a radial annular shoulder surface 120. The wall 114 is circumferentially closed except for openings 122 defined therein for receiving ring connectors 124 of a chain 126 used for lifting the plug container 2 in a manner known to the art and except for the spaces defined between four "ears" defined at the outer end of the wall 114. Parts of three of these "ears" are identified in FIG. 1A by the reference numerals 123*a*, 123*b*, 123*c*. These "ears" can be hammered on to tighten or loosen the cap.

The closure means 10 also includes a transversely extending central wall 128 having a circular cross-sectional area in its plan view. The central wall 128 has a central opening defined therethrough for threadedly receiving a closure plug 130. The closure plug 130 permits access to the interior cavity of the housing 4 for introducing a wire line, for example. The central wall 128 has an upper surface 132 which abuts the annular surface 120 and the surface 118 along the circumferential edge of the wall 128 and which is attached by a weld bead 134 to the surface 116. The central wall 128 has a conical or tapered end wall 136 extending from a longitudinal cylindrical end surface 138 to a bottom surface 140. The tapered surface 136 is welded to the surface 118 by a weld bead 142.

Extending longitudinally or axially from, and in coaxial relationship with, the central wall 128 and its central opening is an interior wall 144 having an annular or sleeve shape. The wall 144 is welded to the central wall 128 at a weld bead 146. Extending radially through the interior wall 144 are two openings 148, 150. The openings 148, 150 permit fluid communication between the exterior of the wall 144 and a hollow interior opening 152 defined by the annular interior wall 144. This fluid communication is important for enabling pressure equalization between the exterior and interior of the wall 144 so that a vacuum or pressure differential between the exterior and interior of the wall is not created when the cementing plug abuts a bottom end surface 154 of the wall 144. The length of the wall 144 is such that a standard cementing plug cannot abut the surface 140 and thereby form a seal against the surface 140. In the embodiment shown in FIG. 1A, the length of the wall 144 is also such that it extends beyond the lower (as viewed in FIG. 1A) edge of the closed outer wall 114 so that an annular space is defined between the sleeve defined by the wall 144 and the surface 118 of the wall 114 of the cap body.

The foregoing construction of the closure means 10 provides a totally fabricated, internally threadable cap without using any castings. Utilization of an internal cap, as opposed to an external cap, provides means for reducing or minimizing the length of the plug container 2.

To provide a fluid-tight seal between the closure means 10 and the housing 4, the plug container 2 further comprises a sealing member 156 which in the preferred embodiment is an O-ring disposed in a circumferential groove 158 defined adjacent the threaded surface in the interior of the box end portion 12 of the housing 4. By positioning the sealing member 156 on the internal wall of the box end portion 12, rather than on the exterior surface of the outer wall 114 of the closure means 10, internal pressure exerted outwardly against the outer wall 114 within the annulus defined between the outer wall 114 and the interior wall 144 will expand the outer wall 114 into (or against) the seal member 156 to maintain a positive seal as pressure within the plug container 2 increases.

A similar type of fluid-tight sealing arrangement is utilized between the flanged, splined end portion 14 of the housing 4 and the casing adapter member 6. FIG. 1B shows that this sealing arrangement includes a seal member 160 disposed in a circumferential groove 162 defined around the interior surface of the flanged, splined end portion 14 of the housing 4.

To utilize the plug container 2, it is lifted by means of the chain 126 to a position above the casing and casing collar to which it is to be connected. The plug container 2 is then lowered and attached to the casing collar in a manner as known to the art.

When the plug container 2 is used in a manifold system, a dual fluid entry manifold is connected to both of the sleeves 42, 46 as known to the art. When the plug container 2 is used in a free-fall system, the sleeve 42 is capped by a suitable cap member of a type as known to the art and a single entry manifold fluid line is connected to the sleeve 46.

To insert a plug into the housing 4, the closure means 10 is unscrewed from the box end portion 12 of the housing 4 and the plug inserted through the open end of the housing 4. The plug is retained by means of the retaining pin 56 in the plug-receiving chamber of the housing 4 between the openings 36, 38.

When the plug retained by the pin 56 is to be released, the handle 58 is suitably actuated as known to the art to retract the pin 56 radially outwardly through the opening 40. The plug then drops into the casing through the casing adapter member 6, thereby actuating the indicator mechanism disposed in the slot 34.

While the plug is retained in the cavity within the housing 4, its end adjacent the closure means 10 can abut the lower end surface 154, but it cannot abut the surface 140. To prevent this abutment from creating a seal which might hold the plug thereagainst, thereby preventing proper release of the plug, the openings 148, 150 are provided to insure pressure equalization between the inside and outside of the interior wall 144 against which the plug can abut.

From the foregoing features of the plug container 2, a shorter and more versatile plug container than heretofore available is provided. Thus, the present invention is well adapted to carry out the objects and attain the ends and advantages mentioned above as well as those inherent therein. While a preferred embodiment of the invention has been described for the purpose of this disclosure, numerous changes in the construction and arrangement of parts can be made by those skilled in the art, which changes are encompassed within the spirit of this invention as defined by the appended claims.

What is claimed is:

1. A plug container for holding a plug having an outer diameter, said plug container comprising:

housing means for receiving said plug, said housing means having first spline means associated with an end thereof and an open end opposite said first spline means;

casing adapter means for engaging with a casing, said casing adapter means having second spline means for coupling with said first spline means;

split ring container means for releasably connecting said first spline means with said second spline means; and closure means for closing said open end, said closure means including:

a closed outer wall;

a central wall extending across said outer wall; and an interior wall extending from said central wall to an end surface of said interior wall, said end surface in abuttable association with said plug when said plug is received in said housing means, said interior wall having an opening defined therethrough so that the pressure within an interior region defined by said interior wall is equalized with the pressure adjacent the exterior of said interior wall.

2. The plug container of claim 1, wherein said housing means has an interior surface having a diameter larger than the outer diameter of said plug so that fluid and pressure can pass between said interior surface and said plug from a location adjacent said first spline means to a location adjacent said opening defined through said interior wall of said closure means when said plug is disposed in said housing means.

3. The plug container of claim 2, wherein:

said housing means includes a threaded interior surface at said open end and further includes a groove defined therein adjacent said threaded interior surface;

said closed outer wall of said closure means includes a threaded exterior surface threadedly connectible with said threaded interior surface; and said plug container further comprises sealing means, disposed in said groove, for providing a seal between said housing means and said closure means, said seal means responsive to pressure exerted outwardly against said closed outer wall.

4. The plug container of claim 3, wherein:

said closed outer wall includes a first annular member with a first inner surface offset radially otuwardly from a second inner surface by an annular shoulder surface;

said central wall includes a circular member with a circumferential edge abutting said first inner surface of said outer wall adjacent said annular shoulder surface, said circular member welded to said annular member; and said interior wall includes a second annular member welded to said circular member in coaxial relationship therewith.

5. The plug container of claim 4, wherein said housing means includes a first threaded fluid-receiving port member, disposed near said open end, and a second threaded fluid-receiving port member, disposed near said first spline means, for connecting with a selectable one of a single entry manifold or a dual entry manifold.

6. The plug container of claim 1, wherein said housing means includes a side wall from which a first fluid-receiving port and a second fluid-receiving port extend, said side wall having a surface extending between said first and second fluid-receiving ports with a diameter greater than the diameter of said plug.

7. The plug container of claim 1, wherein said split ring retainer means includes:

at least two arcuate members, each of said members having an end abutting a respective end of a respective one of the other of said members to form a circular configuration; and bolt means for securing said abutting ends together.

8. The plug container of claim 1, wherein said housing means includes a side wall from which extends fluid-receiving means for connecting with a selectable one of a single entry manifold or a dual entry manifold.

9. A plug container for holding a plug having an outer diameter, said plug container comprising:

a substantially cylindrical plug retainer body having a side wall extending between a flanged, splined end and a box end having a threaded interior surface, said side wall having an inner surface defining a plug-receiving chamber and said side wall further having first and second transverse openings defined therein in longitudinally spaced relation to each other and a third transverse opening longitudinally spaced between the longitudinal positions of said first and second transverse openings, said inner surface having a diameter greater than said outer diameter of said plug;

first threaded sleeve means, welded to said side wall in coaxial relationship with said first opening, for receiving a first fluid flow conductor;

second threaded sleeve means, welded to said side wall in coaxial relationship with said second opening, for receiving a second fluid flow conductor;

third threaded sleeve means, welded to said side wall in coaxial relationship with said third opening, for receiving a plug release plunger mechanism;

a cap having a threaded exterior surface threadedly connectible to said threaded interior surface of said box end, and said cap further having a sleeve extending from said cap into said plug-receiving chamber in coaxial relationship therewith, said sleeve having a radial opening defined therein;

a mating flanged, splined casing adapter member for coupling with said flanged, splined end of said plug retainer body; and split ring retainer means for connecting the flanged portions of said flanged, splined end and said casing adapter member together.

10. The plug retainer of claim 9, wherein said split ring retainer means includes:

a first arcuate member having a first end surface with a first threaded opening defined therein, a second end surface having a first shank-receiving opening defined therein, a first outer surface having a first countersunk opening defined therein in communication with said first shank-receiving opening, and a first inner surface having a first groove defined therein;

a second arcuate member having a third end surface with a second threaded opening defined therein, a fourth end surface having a second shank-receiving opening defined therein, a second outer surface having a second countersunk opening defined therein in communication with said second shank-receiving opening, and a second inner surface having a second groove defined therein;

a third arcuate member having a fifth end surface with a third threaded opening defined therein, a sixth end surface having a third shank-receiving opening defined therein, a third outer surface having a third countersunk opening defined therein in communication with said third shank-receiving opening, and a third inner surface having a third groove defined therein;

first bolt means, disposable through said first countersunk opening and said first shank-receiving opening and said second threaded opening, for securing said first arcuate member to said second arcuate member so that said first and second grooves receive said flanges of said plug retainer body and said casing adapter member;

second bolt means, disposable through said second countersunk opening and said second shank-receiving opening and said third threaded opening, for securing said second arcuate member to said third arcuate member so that said second and third grooves receive said flanges of said plug retainer body and said casing adapter member; and third bolt means, disposable in said third countersunk opening and said third shank-receiving opening and said first threaded opening, for securing said third arcuate member to said first arcuate member so that said first and third grooves receive said flanges of said plug retainer body and said casing adapter member.

11. The plug container of claim 10, further comprising:

first seal means, disposed in said box end, for providing a fluid-tight seal between said plug retainer body and said cap; and second seal means, disposed in said flanged, splined end, for providing a fluid-tight seal between said plug retainer body and said casing adapter member.

* * * * *